US005351172A

United States Patent [19]

Attree et al.

[11] Patent Number: 5,351,172

[45] Date of Patent: Sep. 27, 1994

[54] BACK-LIGHTED DISPLAY PANEL FOR COOLERS

[76] Inventors: Russell C. Attree, 8 Kindswood Rd., Toronto, Ontario, Canada, M4E 3N5; Julian Attree, 398 Cermonial Drive, Missisauga, Ontario, Canada, L5R 2E3; David P. Atkinson, 1264 Abbey Court, Burlington, Ontario, Canada, L7P 3R4

[21] Appl. No.: 28,918

[22] Filed: Mar. 8, 1993

[51] Int. Cl.[5] ..... F21V 15/00; F21V 29/00

[52] U.S. Cl. ..... 362/92; 362/373; 362/812; 40/564

[58] Field of Search ..... 362/92, 96, 126, 253, 362/294, 373, 812, 339; 312/116, 223.5, 236; 40/564

[56] References Cited

U.S. PATENT DOCUMENTS

| | | | |
|---|---|---|---|
| 515,182 | 2/1894 | Warner | 312/116 |
| 1,754,518 | 4/1930 | Kinnie | 312/236 |
| 1,768,800 | 7/1930 | Steiner | 362/126 |
| 4,977,754 | 12/1990 | Upton et al. | 312/116 |
| 5,282,117 | 1/1994 | Fritts | 362/373 |

*Primary Examiner*—Ira S. Lazarus
*Assistant Examiner*—Y. Quach

[57] ABSTRACT

A back-lighted illuminated sign includes a vented light sign cabinet having a light-transmitting front panel , with two side panels, top panel, a bottom panel, and a rear cabinet panel enclosing a cabinet interior having a light source contained therein and wherein said bottom panel includes passive vent openings for admitting a thermally induced draw of cooler ambient air flow there through into the cabinet's interior. The rear cabinet panel includes vent openings arranged adjacent the top panel, for exhausting thermally-induced air flow, at a first temperature, from the cabinet's interior. The cabinet includes spacers for spacing the cabinet from an adjacent freezer in chimney defining relation between the rear cabinet panel and an adjacent exterior panel of the freezer, with air flow admitting and exhausting openings at the lower and upper ends, respectively, of that chimney. The chimney is thereby adapted to channel a secondary thermally-induced air flow, having a second temperature lower than said first temperature, between the rear cabinet panel and the adjacent freezer panel.

8 Claims, 3 Drawing Sheets

FIG. 3
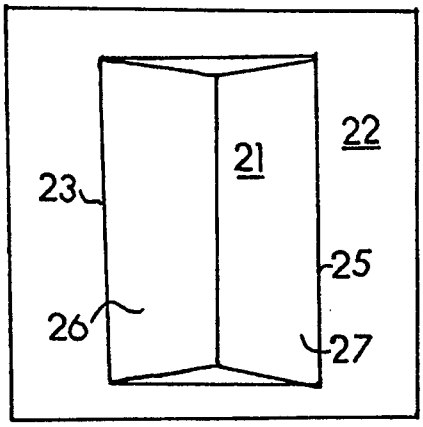
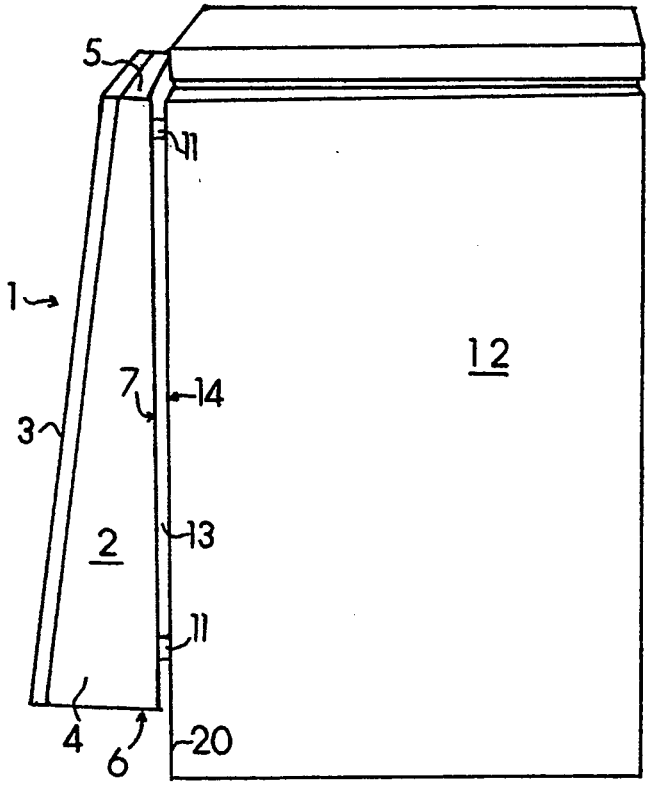
FIG. 2

BACK-LIGHTED DISPLAY PANEL FOR COOLERS

FIELD OF THE INVENTION

This invention relates to back-lighted illuminated display panels for frontal mounting on cooler cabinets, and that are adapted to bear advertising or other visual indicia thereon, especially in combination with active coolers such as refrigerators and in particular, freezers.

BACKGROUND OF THE INVENTION

The use of back-lighted panels for advertising purposes is generally well known and an accepted means for accentuating visual presentations in the promotion and sale of goods and/or services. That having been said, it is implicit in general commercial usage, that the illumination source will give off heat as an unavoidable byproduct. Heated filaments in incandescent lighting, as well as ballasts and bulbs in florescent lighting, all produce significant amounts of such heat. That heat, in most lighting applications, however, is not problematic, and can be dissipated to the ambient environment without significant penalty or any special design considerations. There are, however, applications where this axiom does not apply, and for which, as a consequence, the use of back-lighted illuminated signs are at the very least problematic, if not completely out of the question.

By way of example, coolers for storage of thermally sensitive materials are not readily adapted to be used in immediate conjunction with such signs, owing to thermal transfer from the heat-producing sign, to the cooler, and from there (barring any active intervention), to the thermally sensitive materials contained therein.

These problems are perhaps most acutely manifest in coolers, including such active appliances as refrigerators and especially freezers. Freezers are designed to accommodate a fairly narrow operating window of thermal loading. The proportionate amounts of evaporator and refrigerator coil radiating/absorbing surface areas and compressor capacity are specifically engineered systems for given a given freezer volume, insulation jacketing, and anticipated normal ambient temperature range loadings and usage frequency, in mind. Any operational departures from those design assumptions create manifest inefficiency in the freezers operation, leading at the very least to increased operating costs and early component failure, both of which are incompatible with modern concerns over environmental issues and inevitably also lead to increased capital expenses. Moreover, the cooling capacity of the device can be overloaded to the point where the quality of the contents stored in the freezer can be undesirably compromised. Where a stored product is damaged, any possible benefit that might have accrued through the illuminated advertising is likely to be offset or even undone, through loss of sales not only in the instance of the damaged product, but more importantly and in the longer term, through customer dissatisfaction.

Accordingly, there remains a need in the art for illuminated signs that can accommodate the thermodynamic problems of their association with a cooler. This is *especially* the case with inexpensive domestic type freezers which are particularly vulnerable, when employed in retail settings, to being adversely compromised by the heat given off by any such associated sign. This sensitivity arises from the fact that the inexpensive domestic freezers (characterized by having the heat radiating cools endbedded within the freezer walls and being therefore dependent on the cabinet surface area for heat exchange), are by virtue of their cost, attractive to persons wishing to employ them in retail settings. The frequency of use in the retail setting greatly exceeds the design assumption implicit in the design of a domestic freezer, and therefore represents an extreme taxation on the freezer's operating limits. The addition of an illuminated sign in association with the domestic freezer goes even beyond that, and calls into question the economic merits of associating the domestic freezer with a sign, in retail settings. Features and attendant advantages of the present invention will become apparent to those of ordinary skill in the art as the description thereof proceeds.

SUMMARY OF THE INVENTION

In accordance with a broad aspect of the present invention, there is provided a back-lighted illuminated sign which comprises, amongst other things, a vented light cabinet having a light-transmitting front panel. Additionally, the cabinet has two side panels, a top panel, a bottom panel and rear cabinet panel arranged to enclose a light source (and any attendant electrical or electronic equipment, such as a ballast, for example).

The cabinet's bottom panel includes passive vents for admitting a thermally induced draw of cooler ambient air flow there through into the cabinet's interior. The rear panel also includes vents arranged adjacent the top panel, which latter vents are operable to exhaust thermally-induced air flows, (at a first temperature), from the cabinet's interior.

The cabinet further includes spacers adapted to space the cabinet from an adjacent freezer panel, in chimney defining relation between the rear panel and the exterior panel of the adjacent freezer, complete with air flow admitting and exhausting openings at the lower and upper ends, respectively, of the chimney. The chimney is thereby adapted to channel a secondary thermally-induced air flow, (having a second temperature lower than the first, above-mentioned temperature), between the rear panel and the adjacent freezer panel.

BRIEF DESCRIPTION OF THE DRAWING

FIG. 2 of the drawings is an elevated perspective side view of a sign according to the present invention;

FIG. 3 is a top plan view of a preferred freezer lid window for use in top loading freezers, as a part of a combination according to the present invention; and, FIG. 4 is a generally front-on perspective view of a freezer/sign/window lid combination in accordance with a particularly preferred aspect of the present invention.

DETAILED DESCRIPTION OF A PREFERRED EMBODIMENT

Figure 1:
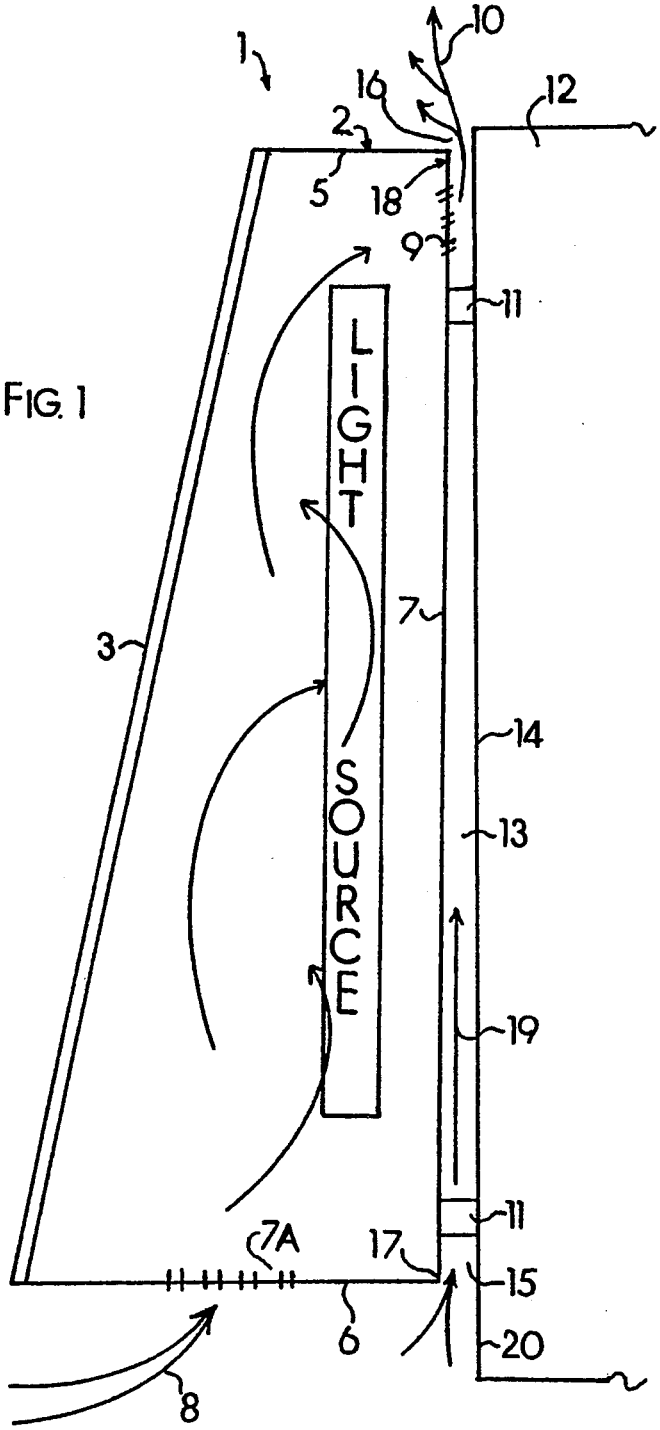
FIG. 1 of the appended drawings is a cross-sectional view taken through a sign according to the present invention, and illustrated in mounted relation on an associated freezer.
Figure 4:
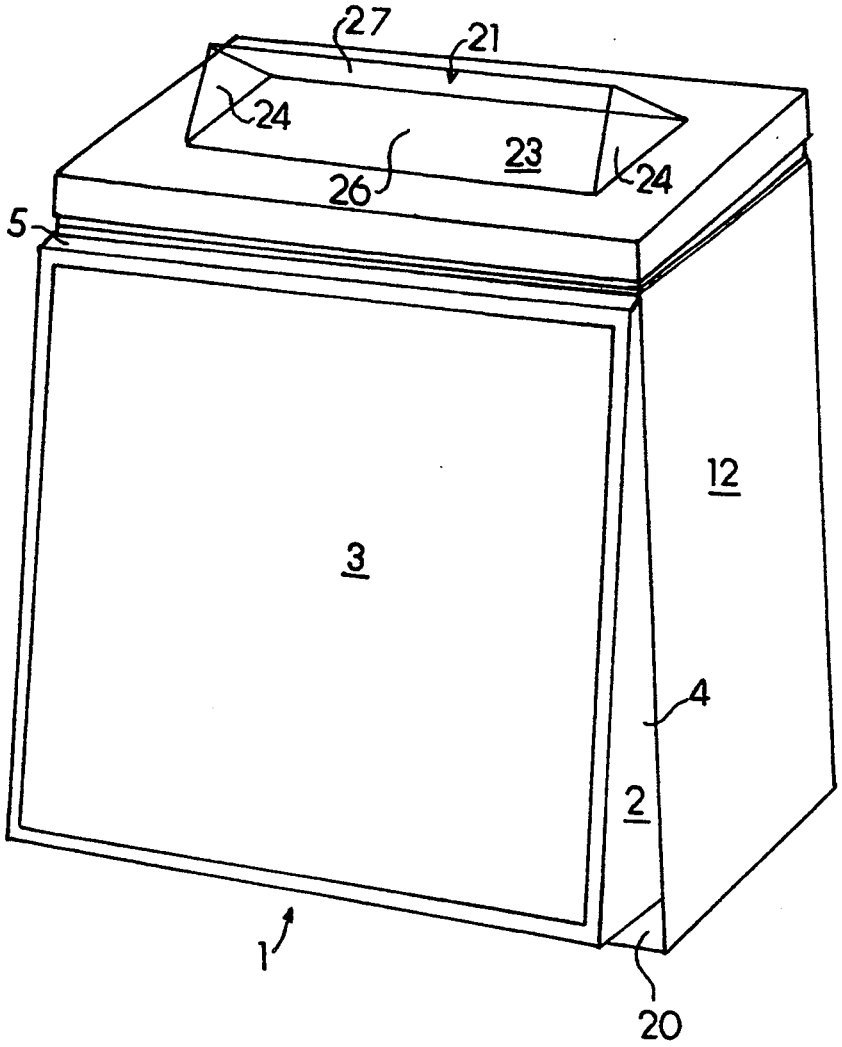

In a particularly preferred aspect of the present invention, there is provided a combination including a freezer, having an evaporator-dissipated-heat radiating panel; and, a back-lighted illuminated sign that is arranged adjacent that freezer panel.

Freezers of the above mentioned type, are typified by modern residential (a.k.a. "domestic") freezers, and distinguish from commercial freezers both with respect to their thermal capacity (which is typically lower than a commercial or industrial unit) and their cost, (which is very much lower than a commercial unit). Commercial units typically utilize higher efficiency evaporator coils to radiate heat extracted from the freezer's interior, and in any case are more heavily insulated and have a higher thermal capacity associated with larger coil surface areas and refrigerant compressors—all of which are adapted to collectively cope with less than ideal operating locations, and the high frequency of opening and closing of the freezer that is implicit in the contemplation of commercial usage. All of this increases the capital costs associated with commercial freezers, and contribute to higher operational costs, and energy consumption as well.

While commercial freezers are generally adapted to the rigours of commercial usage, residential freezers, on the other hand, are likely to find their thermal capacity taxed by the rigours associated, for example, with their use in a retail frozen food outlet. The problems of using the far less expensive residential freezers in such situations is made even less attractive when the freezer is intended to be used at a location where extrinsically generated heat limits the thermal transfer rates from the evaporator, as happens for example, when the freezer is conventionally used in combination with an illuminated sign.

In accordance with the present invention, however, the improved combination comprises: a back-lighted illuminated sign comprising a vented light sign cabinet having a light-transmitting front panel, with two side panels, a top panel, a bottom panel, and a rear cabinet panel enclosing a cabinet interior having a light source contained therein. The bottom panel includes passive vent openings for admitting a thermally-induced draw of cooler ambient air flow there through, and into the cabinet's interior. Similarly, the rear panel includes vent openings arranged adjacent the top panel, for exhausting thermally-induced air flow, at a first temperature, from the cabinet's interior.

The cabinet includes spacers for spacing the cabinet from the adjacent freezer panel, in chimney defining relation between the rear panel and the heat radiating freezer panel. The chimney includes ambient air flow admitting and heated air flow exhausting openings at the lower and upper ends, respectively, of the chimney. In this way, the chimney is adapted to channel a secondary thermally-induced air flow, having a second temperature lower than the above mentioned first temperature, between the rear panel and the heat-radiating freezer panel. In an especially preferred combination according to the present invention, there is provided a combination as generally set forth above, in which there is further included, a window in the freezer lid, adapted to permit a user to examine the contents and reach a selection prior to having to actually open the freezer lid. This will help to minimize the amount of time that the freezer will actually be held open, and therefore reduce the amount of heat that is introduced into the cabinets interior. This too, facilitates the retail setting use of the relatively low capacity domestic freezer, in combination with the sign according to the present invention.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the purposive scope of the appended claims.

Referring now in to the drawings in general, there is illustrated a back-lighted illuminated sign 1 comprising a vented light sign cabinet 2 having a light-transmitting front panel 3.

Two side panes 4 top, bottom, and rear cabinet panels, 4, 5, 6, and 7 respectively, are arranged in light-source-surrounding, cabinet-interior-defining relation.

Bottom panel 6 includes passive vent means **7*a* for admitting a substantially unrestricted thermally induced draw of cooler ambient air flow 8 there through into said cabinet's interior. Rear panel 7 includes vent means 9 arranged adjacent the top panel 5. Vent means 9 is operable for exhausting a thermally-induced air flow 10, at a first temperature, from the cabinet's interior. Locating vent means 9 on rear panel 7 helps to avoid the problems that might attend if foreign matter where to be dropped down through same into the cabinet's interior, where the vent to be placed instead on the top panel 5. More importantly, however, vent means 9 is located on rear panel 7 to promote a secondary convective flow through chimney 13**, across the radiating surface of the adjacent freezer cabinet panel, (as described more fully below).

Cabinet 2 includes spacer means 11 (e.g. blocks, pilings, thick washers, or the like), adapted to space the cabinet 2 from an adjacent freezer 12 in chimney 13 defining relation between the rear panel 7 and an exterior, evaporator-dissipated-heat radiating panel 14 of the freezer 12. Air flow admitting opening 15 and exhausting opening 16 at the lower and upper ends, 17 and 18, respectively, of the chimney 13 are such that chimney 13 is adapted to channel a secondary thermally-induced air flow 19, (having a second temperature lower than said first temperature), between the rear panel 7 and the exterior freezer panel 14.

Cabinet 2 is desirably raised up above the floor in kick-board-spaced relation 20, and also tapered from front to back so as to be shallower adjacent the top thereof, relative to the relatively deeper dimension near the bottom. Note that the top panel 5 is substantially narrower than the bottom panel 6, and that side panels 4 are correspondingly tapered from bottom to top. This arrangement facilitates the ergonometric design considerations that underlie the proportionate dimensions of commercially available top-loading freezer cabinets. The kick-board spacing 20 allows a user to approach the cabinet with feet positioned under the space provided beneath the sign cabinet , thereby preserving the approach distance that is assumed in engineering the height of the freezer cabinet. This allows the use of existing freezer designs to be readily employed in the practice of the present invention without undue ergonometric compromise. At the same time, and every bit as importantly, this feature helps to accommodate the relatively unrestricted ingress of ambient air into the thermal labyrinth of the present sign cabinet/freezer combination. Moreover, the shallower top of the cabinet also minimizes the interference that will be experienced by a user who is trying to lean into the freezer to extract its contents, thereby further accommodating the use of a front-mounted sign with the ergonomically deigned dimensions of currently mass produced domestic top-loading freezers. At the same time the top panel 5, serves as a shelf, on which a product can be temporarily rested, thereby freeing up a user's hands to close the freezer lid. Lastly in this respect, it is noted that the upward tapering of the cabinet enclosure has the effect of accelerating the air flow exiting from the cabinet's interior. This in turn results in better induction of the above mentioned secondary flow.

A window 21 is included in freezer lid 22, to permit a user to view the contents of the freezer's interior. In particular, there is provided in accordance with one such aspect of the present invention, a laterally elongated, generally hollow prism shaped window 23 having triangular end sections 24 arising upwardly from a generally rectangular base opening 25 through the freezer lid 22. Opposed, generally flat front and back rectangular window sections, 26 and 27 respectively, are arranged intermediate the two end sections 24. In this arrangement viewing is facilitated with reduced distortion, shadow-casting, and proper interior illumination. More specifically, the flat front section 26 provides a relatively distortion free viewing window into the cabinet's interior. Moreover, the panel is preferably arranged so that incident light from overhead sources is reflected at an angle away from the average user, so that the problem of glare is reduced. This facilitates viewing and reduces the tendency for the user to hold the freezer lid open while trying to make a selection. This in turn tends to reduce the Mount of heat entering the cabinet in any user transaction, thereby reducing the load on the freezer equipment, and in particular, contributing to the usefulness of domestic freezer equipment in the retail application. At the same time, the rearward section 27 can be angled to admit overhead lighting into the cabinet's interior, to help usefully illuminate same, even while a user is inspecting the interior from the opposed side, through section 26. In other words, the shadow cast by the user while looking down through section 26 need not unduly interfere with the interior illumination, given that light can be admitted without glare, by directing same from an exterior source, through section 27. This too facilitates the objective of holding down the amount of time a user needs to hold the freezer lid open while making a selection from amongst the freezer's contents.

We claim:

1. A back-lighted illuminated sign comprising a vented light sign cabinet having a light-transmitting front panel, with two side panels, a top panel, a bottom panel, and a rear cabinet panel enclosing a cabinet interior having a light source contained therein; and wherein said bottom panel includes passive vent means for admitting a substantially unrestricted thermally induced draw of cooler ambient air flow there through into said cabinet's interior; and wherein said rear cabinet panel includes vent means arranged adjacent said top panel, for exhausting thermally-induced air flow, at a first temperature, from said cabinet's interior; and wherein said cabinet includes spacer means adapted to space said cabinet from an adjacent freezer in chimney defining relation between said rear cabinet panel and an exterior panel on said freezer with air flow admitting and exhausting openings at the lower and upper ends, respectively, of said chimney; wherein said chimney is thereby adapted to channel a secondary thermally-induced air flow, having a second temperature lower than said first temperature, between said rear cabinet panel and said freezer panel.

2. The sign according to claim 1, wherein the cabinet is tapered upwardly inwardly from the bottom panel towards a relatively shallower top panel.

3. In combination, a freezer including an evaporator-dissipated-heat radiating panel, and a back-lighted illuminated sign arranged adjacent said panel heat-radiating freezer , wherein the improvement comprises: a back-lighted illuminated sign comprising a vented light sign cabinet having a light-transmitting front panel, with two side panels, a top panel, a bottom panel, and a rear cabinet panel enclosing a cabinet interior having a light source contained therein; and wherein said bottom panel includes passive vent means for admitting a thermally-induced draw of cooler ambient air flow there through into said cabinet's interior; and wherein said rear cabinet panel includes vent means arranged adjacent said top panel, for exhausting thermally-induced air flow, at a first temperature, from said cabinet's interior; and wherein said cabinet includes spacer means for spacing said cabinet from said adjacent heat-radiating freezer panel in chimney defining relation between said rear cabinet panel and said heat radiating freezer panel with ambient air flow admitting and air flow exhausting openings at the lower and upper ends, respectively, of said chimney; wherein said chimney is thereby adapted to channel a secondary thermally-induced air flow, having a second temperature lower than said first temperature, between said rear cabinet panel and said heat-radiating freezer panel.

4. The combination according to claim 3 wherein said bottom panel of said cabinet is arranged in kickplate raised relation on said freezer panel to thereby permit a user to approach said freezer with feet positioned under a space provided beneath said cabinet.

5. The combination according to claim 4, wherein said freezer is a top-loading freezer, having a lid operably arranged thereon.

6. The combination according to claim 5, further including window means arranged in said lid.

7. The combination according to claim 5, wherein the cabinet is tapered upwardly inwardly from the bottom panel towards a relatively shallower top panel.

8. The combination according to claim 6, wherein said window means comprises a laterally elongated, generally hollow prism shaped window having triangular end sections arising upwardly from a generally rectangular base opening through the freezer lid, and wherein opposed ones of generally flat front and back rectangular window sections are arranged intermediate said two end sections.

* * * * *